US010533554B2

(12) United States Patent
Ohno et al.

(10) Patent No.: US 10,533,554 B2
(45) Date of Patent: Jan. 14, 2020

(54) CYLINDER-ROTATION COMPRESSOR WITH IMPROVED VANE AND SUCTION PASSAGE LOCATIONS

(71) Applicant: DENSO CORPORATION, Kariya, Aichi-pref. (JP)

(72) Inventors: Yuichi Ohno, Nishio (JP); Hiroshi Ogawa, Nishio (JP); Yoshinori Murase, Kariya (JP)

(73) Assignee: DENSO CORPORATION, Kariya (JP)

( * ) Notice: Subject to any disclaimer, the term of this patent is extended or adjusted under 35 U.S.C. 154(b) by 314 days.

(21) Appl. No.: 15/547,251

(22) PCT Filed: Apr. 26, 2016

(86) PCT No.: PCT/JP2016/002186
§ 371 (c)(1),
(2) Date: Jul. 28, 2017

(87) PCT Pub. No.: WO2016/189801
PCT Pub. Date: Dec. 1, 2016

(65) Prior Publication Data

US 2018/0017056 A1 Jan. 18, 2018

(30) Foreign Application Priority Data

May 26, 2015 (JP) ..... 2015-106284

(51) Int. Cl.
*F04C 18/344* (2006.01)
*F04C 29/12* (2006.01)
*F04C 23/00* (2006.01)

(52) U.S. Cl.
CPC ..... *F04C 18/3441* (2013.01); *F04C 29/12* (2013.01); *F04C 23/001* (2013.01); *F04C 2240/20* (2013.01); *F04C 2240/603* (2013.01)

(58) Field of Classification Search
CPC . F04C 18/3441; F04C 2240/603; F04C 29/12
See application file for complete search history.

(56) References Cited

U.S. PATENT DOCUMENTS 2,091,752 A 8/1937 Davis
2,550,540 A 4/1951 Ebsary
(Continued)

FOREIGN PATENT DOCUMENTS

JP 49-106609 A 10/1974

*Primary Examiner* — Mary Davis
(74) *Attorney, Agent, or Firm* — Posz Law Group, PLC

(57) ABSTRACT

A primary groove, into which a primary vane is slidably fitted, and a primary rotor-side suction passage, which conducts refrigerant of a shaft-side suction passage of a shaft to a primary compression chamber, are formed at a primary rotor. The primary groove is shaped into a form that extends from an inner peripheral side toward an outer peripheral side and extends toward a rear side with respect to a rotational direction, and the primary rotor-side suction passage is shaped into a form that extends from the inner peripheral side toward the outer peripheral side and extends and tilts toward a front side with respect to the rotational direction. A fluid outlet of the primary rotor-side suction passage opens at a location that is immediately after the primary groove on the rear side of the primary groove with respect to the rotational direction.

3 Claims, 6 Drawing Sheets

(56) References Cited

U.S. PATENT DOCUMENTS

| | | | | |
|---|---|---|---|---|
| 6,190,149 | B1 * | 2/2001 | Richman | F04C 29/025 418/188 |
| 2015/0176583 | A1 | 6/2015 | Murase et al. | |
| 2016/0115957 | A1 | 4/2016 | Murase et al. | |

* cited by examiner

II — II

Ⅲ－Ⅲ

CYLINDER-ROTATION COMPRESSOR WITH IMPROVED VANE AND SUCTION PASSAGE LOCATIONS

CROSS REFERENCE TO RELATED APPLICATIONS

This application is the U.S. national phase of International Application No. PCT/JP2016/002186 filed on Apr. 26, 2016 and is based on and incorporates herein by reference Japanese Patent Application No. 2015-106284 filed on May 26, 2015.

TECHNICAL FIELD

The present disclosure relates to a cylinder-rotation-type compressor that rotates a cylinder, which forms a compression chamber in an inside of the cylinder.

BACKGROUND ART

Previously, the patent literature 1 discloses a cylinder-rotation-type compressor that rotates a cylinder, which forms a compression chamber in an inside of the cylinder, while an outer-peripheral-side end portion of a vane abuts against an inner peripheral surface of the cylinder.

The cylinder-rotation-type compressor of the patent literature 1 includes the cylinder, a rotor, a shaft and the vane. The cylinder is shaped into a cylindrical tubular form. The rotor is shaped into a cylindrical tubular form and is placed in an inside of the cylinder. The shaft rotatably supports the rotor. The vane is shaped into a plate form and is slidably fitted into a groove (i.e., a slit) formed in the rotor. A compression chamber is formed by a space that is surrounded by an inner peripheral surface of the cylinder, an outer peripheral surface of the rotor and a plate surface of the vane.

Furthermore, in the cylinder-rotation-type compressor of the patent literature 1, a volume of the compression chamber is changed by synchronously rotating the cylinder and the rotor together about two different rotational axes, respectively. More specifically, the volume of the compression chamber is changed by displacing the vane along the groove while an outer-peripheral-side end portion of the vane abuts against the inner peripheral surface of the cylinder at the time of synchronously rotating the cylinder and the rotor together.

Furthermore, in the cylinder-rotation-type compressor of the patent literature 1, a suction passage, which conducts compression-subject fluid drawn from an outside into the compression chamber, is formed in an inside of the shaft and an inside of the rotor. Thereby, the compression-subject fluid is conducted to the compression chamber without increasing complexity of a passage structure of the suction passage and a seal structure.

In the cylinder-rotation-type compressor of the patent literature 1, in a view taken in an axis direction of the shaft, a surface of the groove, along which the plate surface of the vane is slid, is tilted toward a front side with respect to a rotational direction of the rotor. Furthermore, a fluid outlet of the suction passage, which is formed at an outer surface of the rotor, is opened at a location that is relatively apart from the groove and is located on a rear side of the groove with respect to the rotational direction of the rotor.

Therefore, in the cylinder-rotation-type compressor of the patent literature 1, the fluid outlet of the suction passage cannot be immediately communicated with the compression chamber, which has just started a stroke of increasing the volume of the compression chamber (hereinafter, referred to as a suction stroke), so that the pressure of the compression chamber, which has just started the suction stroke, is disadvantageously decreased. The decrease in the pressure described above results in an increase in a drive force of the cylinder-rotation-type compressor, and thereby an energy loss of the compressor is disadvantageously increased.

Furthermore, in the cylinder-rotation-type compressor of the patent literature 1, the fluid outlet of the suction passage cannot be immediately blocked from the compression chamber, which has just started a stroke of reducing the volume of the compression chamber (hereinafter, referred to as a compression stroke), and thereby the fluid cannot be compressed in the compression chamber, which has just started the compression stroke. In such a compression stroke, in which the fluid cannot be compressed, the drive force of the cylinder-rotation-type compressor is consumed wastefully, and the energy loss of the compressor is disadvantageously increased.

CITATION LIST

Patent Literature

PATENT LITERATURE 1: JP2014-238023A

SUMMARY OF INVENTION

The present disclosure is made in view of the above points, and it is an objective of the present disclosure to limit an increase in an energy loss of a cylinder-rotation-type compressor.

The present disclosure is made to achieve the above objective and provides a cylinder-rotation-type compressor including:

a cylinder that is shaped into a cylindrical tubular form and is rotatable about a central axis;

a rotor that is shaped into a cylindrical tubular form and is placed in an inside of the cylinder, wherein the rotor is rotatable about an eccentric axis, which is eccentric to the central axis of the cylinder;

a shaft that rotatably supports the rotor; and a vane that is shaped into a plate form and is slidably inserted into a groove formed in the rotor, while the vane partitions a compression chamber that is formed between an outer peripheral surface of the rotor and an inner peripheral surface of the cylinder, wherein:

the cylinder and the rotor are synchronously rotatable;

when the rotor is rotated, the vane is displaced such that an outer-peripheral-side end portion of the vane contacts the inner peripheral surface of the cylinder;

a shaft-side suction passage, which conducts compression-subject fluid received from an outside, is formed in an inside of the shaft;

a rotor-side suction passage, which conducts the compression-subject fluid outputted from the shaft-side suction passage to the compression chamber, is formed in an inside of the rotor; and in a view taken in an axial direction of the eccentric axis, the groove and the rotor-side suction passage are formed such that the groove and the rotor-side suction passage progressively get closer to each other from an inner peripheral side toward an outer peripheral side of the rotor.

According to the above construction, the groove and the rotor-side suction passage are configured such that the groove and the rotor-side suction passage progressively get closer to each other from an inner peripheral side of the rotor toward an outer peripheral side of the rotor. Therefore, a fluid outlet of the rotor-side suction passage, which is formed at the outer surface of the rotor, can be placed adjacent to a contact location, at which the vane contacts the cylinder.

Thereby, the fluid outlet of the rotor-side suction passage can be immediately communicated with the compression chamber, which is in the state immediately after starting of the suction stroke. Thus, it is possible to limit a decrease in the pressure of the compression chamber that is in the state immediately after the starting of the suction stroke.

Furthermore, it is possible to immediately block the communication of the fluid outlet of the rotor-side suction passage to the compression chamber that is in the state immediately after starting of the compression stroke. Thus, it is possible to limit an occurrence of a state where the fluid is not compressed in the compression chamber that is in the state immediately after the starting of the compression stroke.

As a result, according to the present disclosure, it is possible to limit an increase in the energy loss of the cylinder-rotation-type compressor.

Here, the compression chamber in the suction stroke refers to a compression chamber that is in a stroke, in which the volume of the compression chamber is increased. Furthermore, the compression chamber in the suction stroke is meant to include a compression chamber, which is in the suction stroke and has a volume is zero. Furthermore, the compression chamber in the compression stroke refers to a compression chamber that is in a stroke, in which the volume of the compression chamber is decreased. Furthermore, the compression chamber in the compression stroke is meant to include a compression chamber, which is in the compression stroke and has a maximum volume.

DESCRIPTION OF EMBODIMENTS

Hereinafter, an embodiment of the present disclosure will be described with reference to the drawings. A cylinder-rotation-type compressor 1 (hereinafter, simply referred to as a compressor 1) of the present embodiment is applied to a vapor compression type refrigeration cycle system that cools air to be blown into a cabin of a vehicle by an air conditioning apparatus of the vehicle. The compressor 1 has a function of compressing and discharging a refrigerant (serving as compression-subject fluid) at this refrigeration cycle system.

In this refrigeration cycle system, HFC refrigerant (more specifically, R134a) is used as the refrigerant, and the refrigeration cycle system forms a sub-critical refrigeration cycle, in which a high-pressure-side refrigerant pressure does not exceed a critical pressure of the refrigerant. Furthermore, the refrigerant contains refrigerating machine oil, which is lubricant oil for lubricating slidable parts of the compressor 1, and a portion of the refrigerating machine oil is circulated along with the refrigerant in the cycle.

Figure 1:
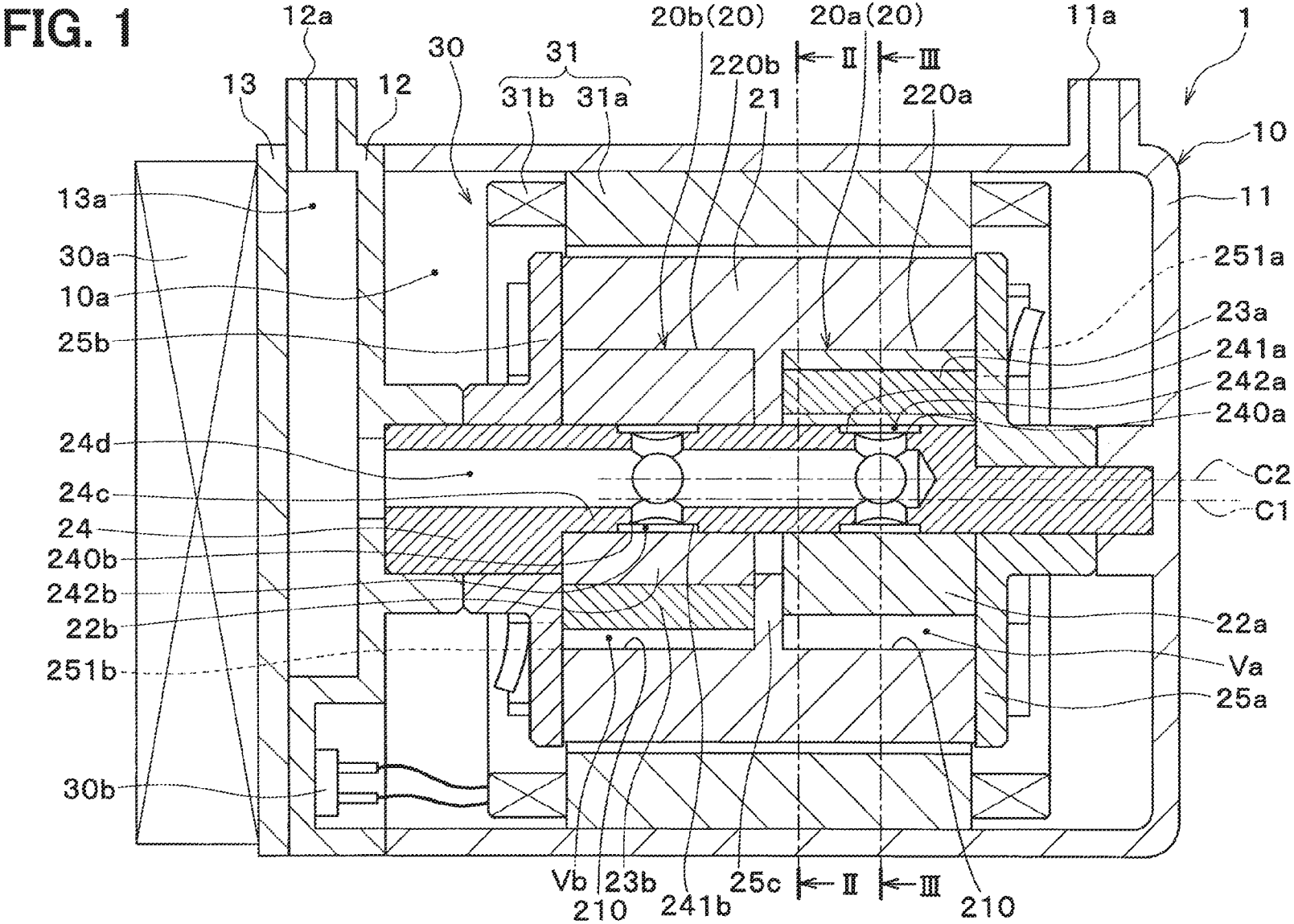
FIG. 1 is an axial cross-sectional view of a compressor according to an embodiment of the present disclosure.

As shown in FIG. 1, the compressor 1 is formed as an electric compressor that includes a compression mechanism 20 and an electric motor unit 30, which are received in an inside of a housing 10 that forms an outer shell of the compressor 1. The compression mechanism 20 compresses and discharges refrigerant, and the electric motor unit 30 drives the compression mechanism 20. The housing 10 is formed by combining a plurality of metal members, and the housing 10 has a sealed container structure that forms a generally cylindrical space 10*a* in an inside of the housing 10.

More specifically, as shown in FIG. 1, the housing 10 is formed by integrally combining a main housing 11, which is shaped into a bottomed cylindrical tubular form (i.e., a cup form), a sub-housing 12, which is shaped into a bottomed cylindrical tubular form and is placed to close an opening portion of the main housing 11, and a cover member 13, which is shaped into a circular disk form and is placed to close an opening portion of the sub-housing 12.

A seal member (not shown), such as an O-ring, is interposed between each adjacent two contacting portions of the main housing 11, the sub-housing 12 and the cover member 13, so that the refrigerant does not leak out from the contacting portions.

A discharge port 11*a* is formed at a tubular peripheral surface of the main housing 11 to discharge the high pressure refrigerant, which is pressurized by the compression mechanism 20, to an outside of the housing 10 (more specifically, a refrigerant inlet of a condenser of the refrigeration cycle system). A suction port 12*a* is formed at a tubular peripheral surface of the sub-housing 12 to suction the low pressure refrigerant from the outside of the housing 10 (more specifically, the low pressure refrigerant outputted from an evaporator of the refrigeration cycle system).

A housing-side suction passage 13*a* is formed between the sub-housing 12 and the cover member 13 to conduct the low pressure refrigerant, which is suctioned through the suction port 12*a*, to primary and secondary compression chambers Va, Vb of the compression mechanism 20. Furthermore, a drive circuit 30*a*, which is an inverter that supplies an electric power to the electric motor unit 30, is installed to an opposite surface of the cover member 13, which is opposite from the sub-housing 12.

Next, the electric motor unit 30 includes a stator 31, which serves as a stator. The stator 31 includes a stator core 31*a*, which is made of a metal magnetic material, and stator coils 31*b*, which are wound around the stator core 31*a*. The stator 31 is fixed to an inner peripheral surface of a tubular peripheral wall of the main housing 11 by, for example, press fitting, shrink fitting or bolting.

When the electric power is supplied from the drive circuit 30*a* to the stator coils 31*b* through seal terminals (i.e., hermetic seal terminals) 30*b*, a rotating magnetic field, which rotates a cylinder 21 that is placed at an inner peripheral side of the stator 31, is generated. The cylinder 21 is made of a metal magnetic material, which is shaped into a cylindrical tubular form. The cylinder 21 forms the primary and secondary compression chambers Va, Vb of the compression mechanism 20, as described later.

Figure 2:
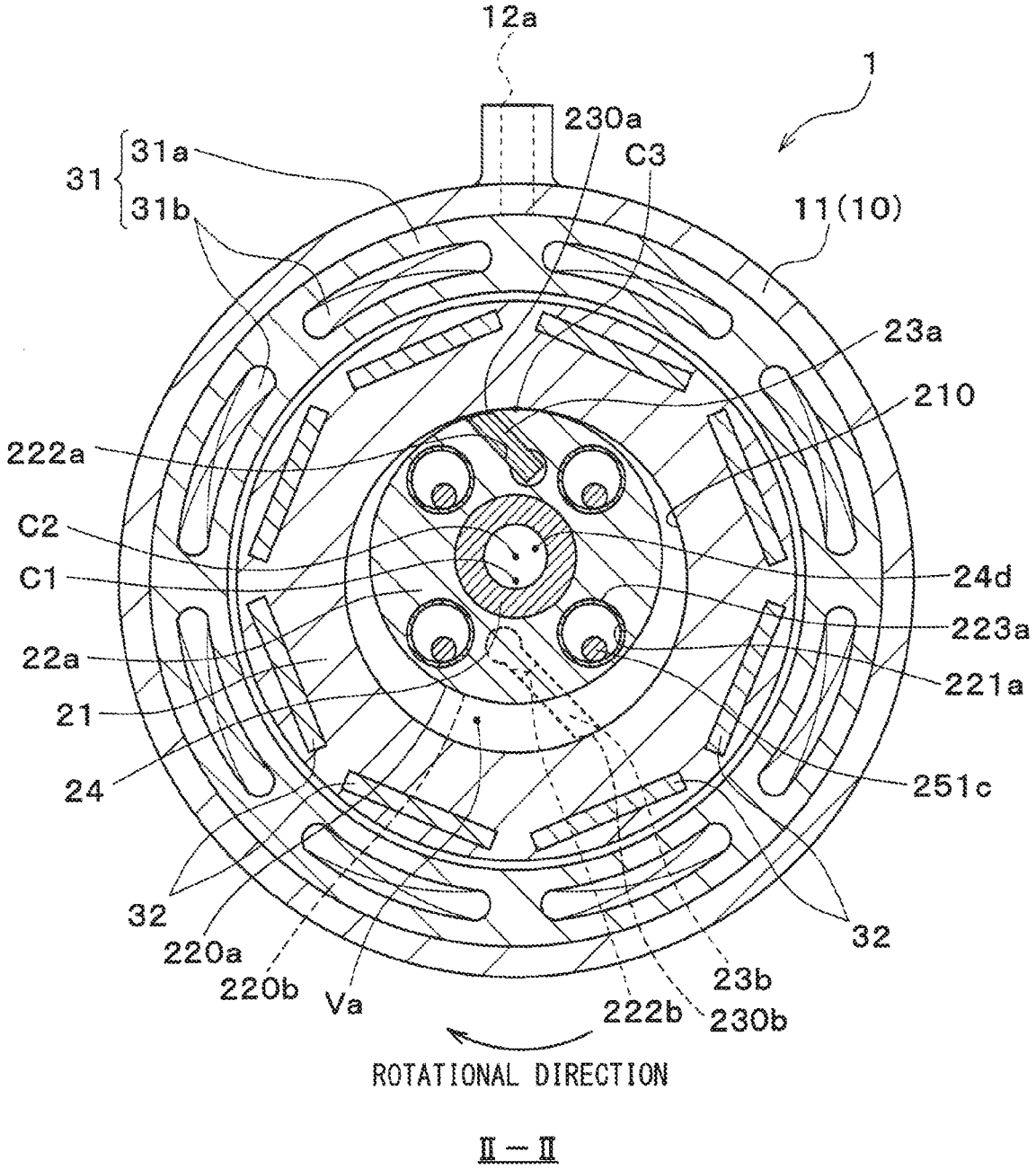
FIG. 2 is a cross-sectional view taken along line II-II in FIG. 1.
Figure 3:
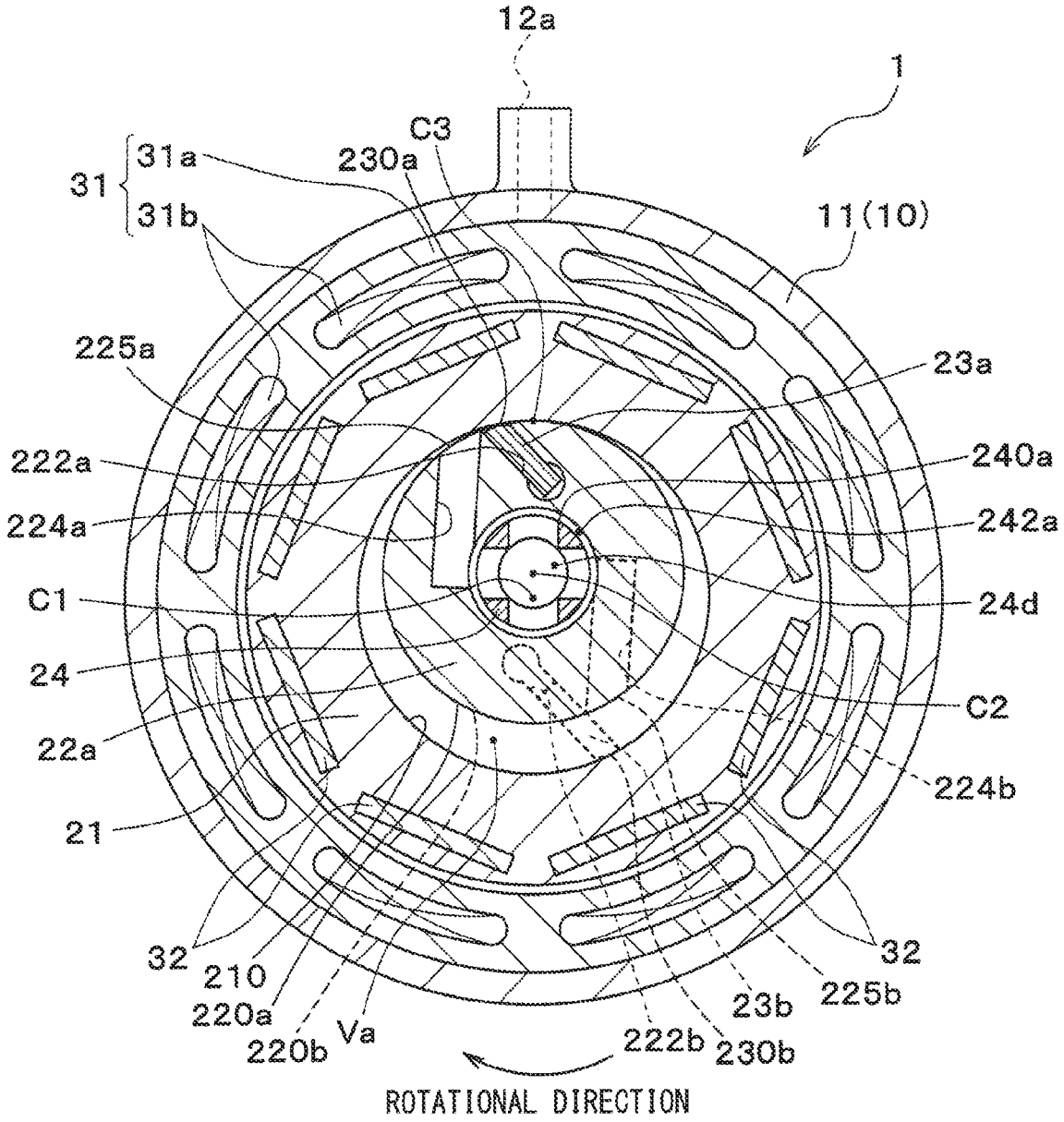
FIG. 3 is a cross-sectional view taken along line III-III in FIG. 1.

Furthermore, as shown in cross-sectional views of FIGS. 2 and 3, permanent magnets 32 are fixed to the cylinder 21. In this way, the cylinder 21 has a function of a rotor of the electric motor unit 30. The cylinder 21 is rotated about a central axis C1 by the rotating magnetic field, which is generated by the stator 31.

That is, in the compressor 1 of the present embodiment, the rotor of the electric motor unit 30 and the cylinder 21 of the compression mechanism 20 are integrally formed as a one-piece body. Here, it should be understood that the rotor of the electric motor unit 30 and the cylinder 21 of the compression mechanism 20 may be formed by separate members, respectively, and may be integrated together by, for example, press fitting. Furthermore, the stator 31 of the electric motor unit 30 (more specifically, the stator core 31*a* and the stator coils 31*b*) is placed at an outer peripheral side of the cylinder 21.

Next, the compression mechanism 20 will be described. In the present embodiment, two compression mechanisms, i.e., a primary compression mechanism 20*a* and a secondary compression mechanism 20*b* are provided as the compression mechanism 20. A basic structure of the primary compression mechanism 20*a* and a basic structure of the secondary compression mechanism 20*b* are substantially identical to each other. The primary and secondary compression mechanisms 20*a*, 20*b* are connected in parallel with respect to a refrigerant flow in the inside of the housing 10.

Figure 4:
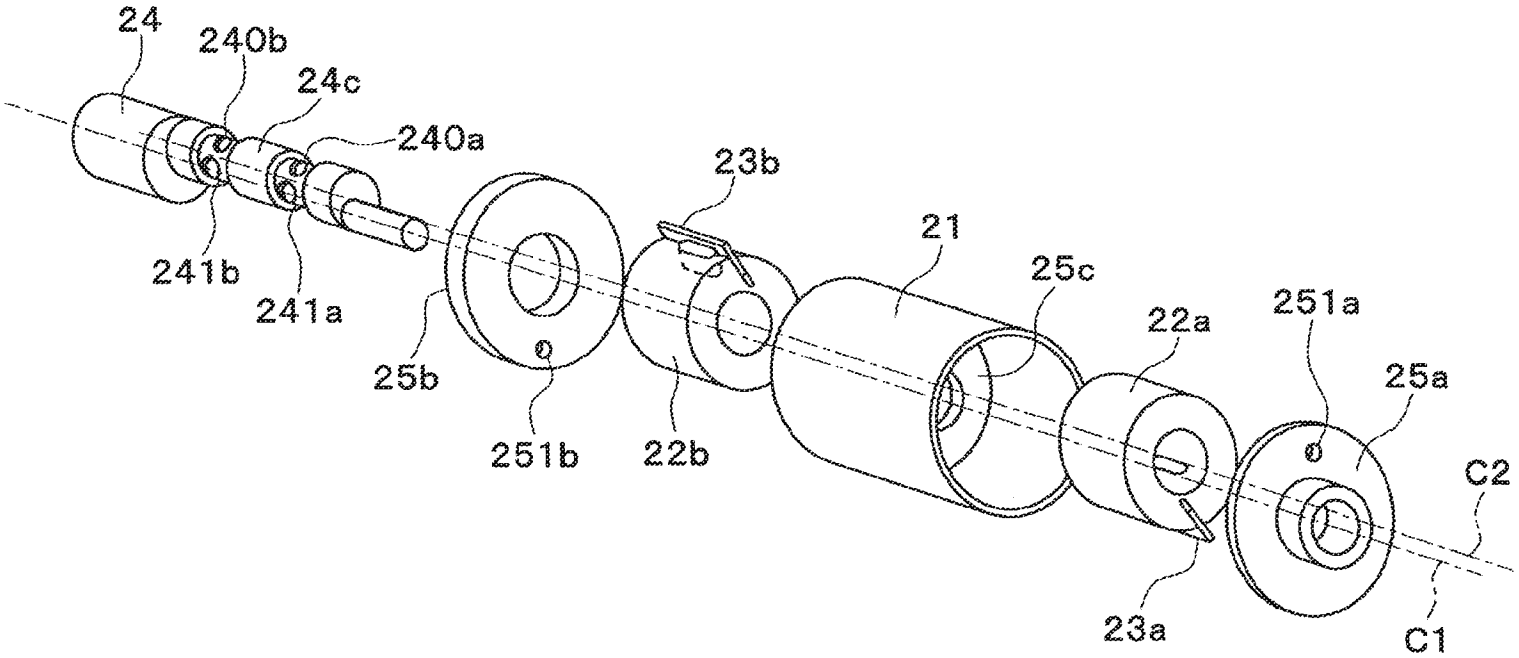
FIG. 4 is an exploded perspective view of a compression mechanism of the embodiment.

Furthermore, as shown in FIGS. 1 and 4, the primary and secondary compression mechanisms 20*a*, 20*b* are arranged one after another in an axial direction of a central axis of the cylinder 21. In the present embodiment, one of the two compression mechanisms, which is placed at a bottom surface side of the main housing 11 (i.e., one end side in the axial direction), is the primary compression mechanism 20*a*, and the other one of the two compression mechanisms, which is placed at the sub-housing 12 side (i.e., the other end side in the axial direction), is the secondary compression mechanism 20*b*.

Furthermore, in each of the corresponding drawings, the constituent components of the secondary compression mechanism 20*b*, which correspond to equivalent constituent components of the primary compression mechanism 20*a*, will be indicated by changing a last alphabet of the corresponding reference sign from "a" to "b". For example, among the constituent components of the secondary compression mechanism 20*b*, a secondary rotor, which is the constituent component that corresponds to a primary rotor 22*a* of the primary compression mechanism 20*a*, will be indicated by the reference sign "22*b*."

The primary compression mechanism 20*a* is formed by, for example, the cylinder 21, the primary rotor 22*a*, a primary vane 23*a* and a shaft 24. The secondary compression mechanism 20*b* is formed by, for example, the cylinder 21, the secondary rotor 22*b*, a secondary vane 23*b* and the shaft 24. Specifically, as shown in FIG. 1, one portion of the cylinder 21 and one portion of the shaft 24, which are located at the bottom surface side of the main housing 11, form the primary compression mechanism 20*a*, and another portion of the cylinder 21 and another portion of the shaft 24, which are located at the sub-housing 12 side, form the secondary compression mechanism 20*b*.

The cylinder 21 is a cylindrical tubular member that serves as the rotor of the electric motor unit 30 and is rotated about the central axis C1, as discussed above. Furthermore, the cylinder 21 forms the primary compression chamber Va of the primary compression mechanism 20*a* and the secondary compression chamber Vb of the secondary compression mechanism 20*b* in the inside of the cylinder 21. A primary side plate 25*a*, which is a closure member that closes an opening end portion of the cylinder 21, is fixed to one axial end of the cylinder 21 by, for example, bolting. Furthermore, a secondary side plate 25*b* is fixed to the other axial end of the cylinder 21 in a manner similar to that of the primary side plate 25*a*.

Each of the primary and secondary side plates 25*a*, 25*b* includes a circular disk portion, which extends in a direction that is generally perpendicular to the rotational axis of the cylinder 21, and a boss portion, which is placed at a center part of the circular disk portion and projects in the axial direction. Furthermore, the boss portion of each of the primary and secondary side plates 25*a*, 25*b* includes a through-hole that extends through the boss portion.

A bearing mechanism (not shown) is placed in each of these through-holes. The shaft 24 is inserted into the bearing mechanism of each through-hole, so that the cylinder 21 is supported in a rotatable manner relative to the shaft 24. Two opposite end portions of the shaft 24 are fixed to the housing 10 (more specifically, the main housing 11 and the sub-housing 12, respectively). Therefore, the shaft 24 does not rotate relative to the housing 10.

Furthermore, the primary compression chamber Va and the secondary compression chamber Vb, which are partitioned from each other, are formed in the inside of the cylinder 21 of the present embodiment. Therefore, an intermediate side plate 25*c*, which is shaped into a circular disk form and partitions between the primary compression chamber Va and the secondary compression chamber Vb, is placed between the primary rotor 22*a* and the secondary rotor 22*b* in the inside of the cylinder 21. The intermediate side plate 25*c* has a function that is similar to the function of the primary and secondary side plates 25*a*, 25*b*.

Specifically, two opposite axial end parts of the one portion of the cylinder 21 of the present embodiment, which forms the primary compression mechanism 20*a*, are closed by the primary side plate 25*a* and the intermediate side plate 25*c*, respectively. Furthermore, two opposite axial end parts of the other portion of the cylinder 21, which forms the secondary compression mechanism 20*b*, are closed by the secondary side plate 25*b* and the intermediate side plate 25*c*, respectively.

In other words, the primary side plate 25*a* cooperates with the intermediate side plate 25*c* and the primary rotor 22*a* to partition the primary compression chamber Va. The secondary side plate 25*b* cooperates with the intermediate side plate 25*c* and the secondary rotor 22*b* to partition the secondary compression chamber Vb. Furthermore, the intermediate side plate 25*c* is placed between the primary rotor 22*a* and the secondary rotor 22*b* to partition between the primary compression chamber Va and the secondary compression chamber Vb.

In the present embodiment, the cylinder 21 and the intermediate side plate 25*c* are integrally formed as a one-piece body. Alternatively, the cylinder 21 and the intermediate side plate 25*c* may be formed by separate members, respectively, and may be integrated together by, for example, press fitting.

Furthermore, in the present embodiment, the intermediate side plate 25*c* is placed generally at an axial center part of the cylinder 21. Therefore, an axial length of the primary rotor 22*a* and an axial length of the secondary rotor 22*b* are generally equal to each other, and the primary compression chamber Va and the secondary compression chamber Vb are partitioned from each other in such a manner that a maximum volume of the primary compression chamber Va and a maximum volume of the secondary compression chamber Vb are generally equal to each other.

The shaft 24 is a member that is shaped into a generally cylindrical tubular form and rotatably supports the cylinder 21 (more specifically, the side plates 25*a*, 25*b*, 25*c* fixed to the cylinder 21), the primary rotor 22*a* and the secondary rotor 22*b*.

An axial center part of the shaft 24 includes an eccentric portion 24*c*, which has an outer diameter that is smaller than an outer diameter of the end part of the shaft 24 located at the sub-housing 12 side. A central axis of the eccentric portion 24*c* is an eccentric axis C2 that is eccentric to the central axis C1 of the cylinder 21. Furthermore, each of the primary and secondary rotors 22*a*, 22*b* is rotatably supported by the eccentric portion 24*c* through a corresponding bearing mechanism (not shown).

Therefore, at the time of rotating the primary and secondary rotors 22*a*, 22*b*, the primary and secondary rotors 22*a*, 22*b* are rotated about the common eccentric axis C2. In other words, in the present embodiment, the eccentric axis of the primary rotor 22*a* and the eccentric axis of the secondary rotor 22*b* are coaxially placed. As shown in FIG. 1, a shaft-side suction passage 24*d* is formed in the inside of the shaft 24 such that the shaft-side suction passage 24*d* is communicated with the housing-side suction passage 13*a* and conducts the low pressure refrigerant, which is supplied from the outside, to the primary and secondary compression chambers Va, Vb. A plurality (four in this embodiment) of primary-shaft-side outlet holes 240*a* and a plurality (four in this embodiment) of secondary-shaft-side outlet holes 240*b*, which output the low pressure refrigerant conducted through the shaft-side suction passage 24*d*, are opened at an outer peripheral surface of the shaft 24.

As shown in FIGS. 1 and 4, primary-shaft-side and secondary-shaft-side recesses 241*a*, 241*b* are formed at the outer peripheral surface of the shaft 24 by recessing the outer peripheral surface of the shaft 24 toward the inner peripheral side. The primary-shaft-side and secondary-shaft-side outlet holes 240*a*, 240*b* are opened at the primary-shaft-side and secondary-shaft-side recesses 241*a*, 241*b*, respectively.

Therefore, the primary-shaft-side and secondary-shaft-side outlet holes 240*a*, 240*b* are respectively communicated with primary-shaft-side and secondary-shaft-side communication spaces 242*a*, 242*b*, which are respectively shaped into an annular form and are formed in the primary-shaft-side and secondary-shaft-side recesses 241*a*, 241*b*, respectively.

The primary rotor 22*a* is a cylindrical tubular member that is placed in the inside of the cylinder 21 and extends in the axial direction of the central axis of the cylinder 21. As shown in FIG. 1, an axial length of the primary rotor 22*a* is substantially equal to an axial length of the one portion of the shaft 24 and of the one portion of the cylinder 21, which form the primary compression mechanism 20*a*.

Furthermore, an outer diameter of the primary rotor 22*a* is smaller than an inner diameter of a cylindrical space formed in the inside of the cylinder 21. Specifically, as shown in FIGS. 2 and 3, in a view taken in the axial direction of the eccentric axis C2, the outer diameter of the primary rotor 22*a* is set such that the outer peripheral surface (outer surface) 220*a* of the primary rotor 22*a* and an inner peripheral surface 210 of the cylinder 21 contact with each other at a single contact point C3.

A drive force transmission mechanism is placed between the primary rotor 22*a* and the intermediate side plate 25*c*, and another drive force transmission mechanism is placed between the primary rotor 22*a* and the primary side plate 25*a*. The drive force transmission mechanisms transmit the rotational drive force from the cylinder 21 (more specifically, the intermediate side plate 25*c* and the primary side plate 25*a*, which are rotated together with the cylinder 21) to the primary rotor 22*a* to rotate the primary rotor 22*a* synchronously with the cylinder 21.

One of the drive force transmission mechanisms, which is placed between the primary rotor 22*a* and the intermediate side plate 25*c*, will now be described as an example. As shown in FIG. 2, the drive force transmission mechanism includes a plurality (four in this embodiment) of primary holes 221*a*, which are respectively shaped into a circular form and are formed at a side surface of the primary rotor 22*a* located on the intermediate side plate 25*c* side, and a plurality (four in this embodiment) of drive pins 251*c*, which project from the intermediate side plate 25*c* toward the primary rotor 22*a* side in the axial direction of the central axis.

An outer diameter of each of the drive pins 251*c* is set to be smaller than an inner diameter of a corresponding one of the primary holes 221*a*, and each of the drive pins 251 projects toward the primary rotor 22*a* side and is fitted into the corresponding one of the primary holes 221*a*. That is, each of the drive pins 251*c* and the corresponding one of the primary holes 221*a* form a mechanism that is equivalent to a pin and hole type self-rotation limiting mechanism. The drive force transmission mechanism, which is placed between the primary rotor 22*a* and the primary side plate 25*a*, has a structure that is similar to the above-described drive force transmission mechanism.

With the drive force transmission mechanisms of the present embodiment, when the cylinder 21 is rotated about the central axis C1, a relative position and a relative distance between each of the drive pins 251*c* and the eccentric portion 24*c* of the shaft 24 are changed. Due to the change in the relative position and the change in the relative distance, an inner peripheral wall surface of the primary hole 221*a* of the primary rotor 22*a* receives a load from the drive pin 251*c* in the rotational direction. Thereby, the primary rotor 22*a* is rotated about the eccentric axis C2 synchronously with the rotation of the cylinder 21.

In the drive force transmission mechanism of the present embodiment, the drive force is sequentially transmitted to the primary rotor 22*a* through the drive pins 251*c* and the primary holes 221*a*. Therefore, it is desirable that the drive pins 251*c* are arranged one after another at equal intervals about the eccentric axis C2, and the primary holes 221*a* are arranged one after another at equal intervals about the eccentric axis C2. Furthermore, a ring member 223*a*, which is made of metal, is fitted into each of the primary holes 221*a* to limit wearing of an outer peripheral side wall surface of the primary hole 221*a*.

As shown in FIGS. 2 and 3, a primary groove (i.e., a primary slit) 222*a* is formed at the outer peripheral surface 220*a* of the primary rotor 22*a* such that the primary rotor 22*a* is recessed toward the inner peripheral side along the entire axial extent of the outer peripheral surface 220*a*. A primary vane 23*a*, which will be described later, is slidably fitted into the primary groove 222*a*.

In the view taken in the axial direction of the eccentric axis C2, the primary groove 222*a* is shaped into a form, which extends in a direction that is tilted relative to the radial direction of the primary rotor 22*a*. Thereby, in the view taken in the axial direction of the eccentric axis C2, a surface of the primary groove 222*a*, along which the primary vane 23*a* is slid, (i.e., a friction surface of the primary groove 222*a*, which is in frictional contact with the primary vane 23*a*) is tilted relative to the radial direction of the primary rotor 22*a*.

Therefore, the primary vane 23*a*, which is fitted into the primary groove 222*a*, is displacable in a direction that is tilted relative to the radial direction of the primary rotor 22*a*. Thereby, in the primary groove 222*a*, a contact surface area between the primary groove 222*a* and the primary vane 23*a* can be increased in comparison to a case where the friction surface of the primary groove 222*a*, which is in frictional contact with the primary vane 23*a*, is formed to extend in the radial direction. Furthermore, even when the primary vane 23*a* is displaced, the primary vane 23*a* can be reliably held in the inside of the primary groove 222*a*.

Furthermore, the primary groove 222*a* is shaped into a form, which extends from the inner peripheral side toward the outer peripheral side of the primary rotor 22*a* and extends and tilts toward the rear side with respect to the rotational direction of the primary rotor 22*a*.

As shown in FIG. 3, a primary-rotor-side suction passage 224*a*, which communicates between an inner peripheral side (i.e., the primary-shaft-side communication space 242*a*) and an outer peripheral side (i.e., the primary compression chamber Va) of the primary rotor 22*a*, is formed in an inside of an axial center part of the primary rotor 22*a*. Thereby, the refrigerant, which is supplied from the outside into the shaft-side suction passage 24*d*, is conducted to the primary-rotor-side suction passage 224*a*.

Furthermore, as shown in FIG. 3, in the view taken in the axial direction of the eccentric axis C2, the primary-rotor-side suction passage 224*a* of the present embodiment is shaped into a form, which extends from the inner peripheral side toward the outer peripheral side of the primary rotor 22*a* and extends and tilts toward a front side with respect to the rotational direction.

Therefore, the primary groove 222*a* and the primary-rotor-side suction passage 224*a* of the present embodiment progressively get closer to each other from the inner peripheral side toward the outer peripheral side of the primary rotor 22*a*. Furthermore, as shown in FIG. 3, a fluid outlet 225*a* of the primary-rotor-side suction passage 224*a*, which is formed at an outer peripheral surface (outer surface) 220*a* of the primary rotor 22*a*, opens at a corresponding location of the outer peripheral surface 220*a*, which is immediately after the primary groove 222*a* on the rear side the primary groove 222*a* with respect to the rotational direction of the primary rotor 22*a*. In other words, at the outer peripheral surface 220*a* of the primary rotor 22*a*, the fluid outlet 225*a* opens at the corresponding location, which is on the rear side of the location of the primary groove 222*a* with respect to the rotational direction (i.e., on one side of the primary groove 222*a* in the counter-rotational direction that is opposite from the rotational direction) and is adjacent to the location of the primary groove 222*a*.

The primary vane 23*a* is a partition member that is in a plate form and partitions the primary compression chamber Va, which is formed between the outer peripheral surface 220*a* of the primary rotor 22*a* and the inner peripheral surface 210 of the cylinder 21. An axial length of the primary vane 23*a* is substantially equal to an axial length of the primary rotor 22*a*. Furthermore, an outer-peripheral-side end portion 230*a* of the primary vane 23*a* is slidable relative to the inner peripheral surface 210 of the cylinder 21.

Therefore, at the primary compression mechanism 20*a* of the present embodiment, the primary compression chamber Va is formed by a space that is surrounded by the inner peripheral surface (the inner wall surface) 210 of the cylinder 21, the outer peripheral surface 220*a* of the primary rotor 22*a*, a plate surface of the primary vane 23*a*, the primary side plate 25*a* and the intermediate side plate 25*c*. That is, the primary vane 23*a* partitions the primary compression chamber Va, which is formed between the inner peripheral surface 210 of the cylinder 21 and the outer peripheral surface 220*a* of the primary rotor 22*a*.

Furthermore, a primary discharge hole 251*a*, which discharges the refrigerant compressed in the primary compression chamber Va to an inside space 10*a* of the housing 10, is formed in the primary side plate 25*a*. Furthermore, a primary discharge valve, which is made of a reed valve, is installed to the primary side plate 25*a*. The primary discharge valve limits backflow of the refrigerant, which is previously outputted from the primary discharge hole 251*a* to the inside space 10*a* of the housing 10, to the primary compression chamber Va through the primary discharge hole 251*a*.

Next, the secondary compression mechanism 20*b* will be described. As discussed above, the basic structure of the secondary compression mechanism 20*b* is the same as that of the primary compression mechanism 20*a*. Therefore, as shown in FIG. 1, the secondary rotor 22*b* is made of a cylindrical tubular member that has an axial length, which is substantially equal to an axial length of the other portion of the shaft 24 and the other portion of the cylinder 21, which form the secondary compression mechanism 20*b*.

Furthermore, the eccentric axis C2 of the secondary rotor 22*b* and the eccentric axis C2 of the primary rotor 22*a* are coaxially placed. Therefore, in the view taken in the axial direction of the eccentric axis C2, an outer peripheral surface 220*b* of the secondary rotor 22*b* and the inner peripheral surface 210 of the cylinder 21 contact with each other at a single contact point C3 shown in FIGS. 2 and 3 like in the case of the primary rotor 22*a*.

Drive force transmission mechanisms, which are similar to the transmission mechanisms that transmit the rotational drive force to the primary rotor 22*a*, are respectively placed at a location between the secondary rotor 22*b* and the intermediate side plate 25*c* and a location between the secondary rotor 22*b* and the primary side plate 25*a*. Therefore, a plurality of secondary holes is formed in the secondary rotor 22*b*. The secondary holes are respectively shaped into a circular form, and a plurality of drive pins 251*c* is fitted into the secondary holes, respectively. Ring members, which are similar to the ring members fitted into the primary holes 221*a*, are fitted into the secondary holes.

Furthermore, as indicated by a dotted line in FIGS. 2 and 3, a secondary groove (i.e., a secondary slit) 222*b* is recessed toward the inner peripheral side along the entire axial extent of the outer peripheral surface 220*b* of the secondary rotor 22*b*. A secondary vane 23*b* is slidably fitted into the secondary groove 222*b*. An outer-peripheral-side end portion 230*b* of the secondary vane 23*b* is slidable relative to the inner peripheral surface 210 of the cylinder 21.

In the view taken in the axial direction of the eccentric axis C2, similar to the primary groove 222*a*, the secondary groove 222*b* is shaped into a form, which extends in a direction that is tilted relative to the radial direction of the secondary rotor 22*b*. More specifically, the secondary groove 222*b* is shaped into a form, which extends from the inner peripheral side toward the outer peripheral side of the secondary rotor 22*b* and extends and tilts toward the rear side with respect to the rotational direction of the secondary rotor 22*b*.

Similar to the primary-rotor-side suction passage 224*a*, a secondary-rotor-side suction passage 224*b* is formed in an inside of an axial center part of the secondary rotor 22*b*. As indicated by a dotted line in FIG. 3, the secondary-rotor-side suction passage 224*b* extends from the inner peripheral side toward the outer peripheral side of the secondary rotor 22*b* and extends and tilts toward the front side with respect to the rotational direction of the secondary rotor 22*b*. The secondary-rotor-side suction passage 224*b* communicates between the inner peripheral side and the outer peripheral side (i.e., the secondary compression chamber Vb side) of the secondary rotor 22*b*.

Therefore, at the secondary compression mechanism 20*b* of the present embodiment, the secondary compression chamber Vb is formed by a space that is surrounded by the inner peripheral surface (the inner wall surface) 210 of the cylinder 21, the outer peripheral surface 220*b* of the secondary rotor 22*b*, the plate surface of the secondary vane 23*b*, the secondary side plate 25*b* and the intermediate side plate 25*c*. That is, the secondary vane 23*b* partitions the secondary compression chamber Vb, which is formed between the inner peripheral surface 210 of the cylinder 21 and the outer peripheral surface 220*b* of the secondary rotor 22*b*.

Furthermore, a secondary discharge hole 251*b*, which discharges the refrigerant compressed in the secondary compression chamber Vb to the inside space 10*a* of the housing 10, is formed in the secondary side plate 25*b*. Furthermore, a secondary discharge valve, which is made of a reed valve, is installed to the secondary side plate 25*b*. The secondary discharge valve limits backflow of the refrigerant, which is previously outputted from the secondary discharge hole 251*b* to the inside space 10*a* of the housing 10, to the secondary compression chamber Vb through the secondary discharge hole 251*b*.

Furthermore, at the secondary compression mechanism 20*b* of the present embodiment, as indicated by dotted lines in FIGS. 2 and 3, the secondary vane 23*b*, the secondary-rotor-side suction passage 224*b* and the secondary discharge hole 251*b* of the secondary side plate 25*b* are placed at corresponding locations, which are generally 180 degrees displaced from the locations of the primary vane 23*a*, the primary-rotor-side suction passage 224*a* and the primary discharge hole 251*a* of the primary side plate 25*a* at the primary compression mechanism 20*a*.

Figure 5:
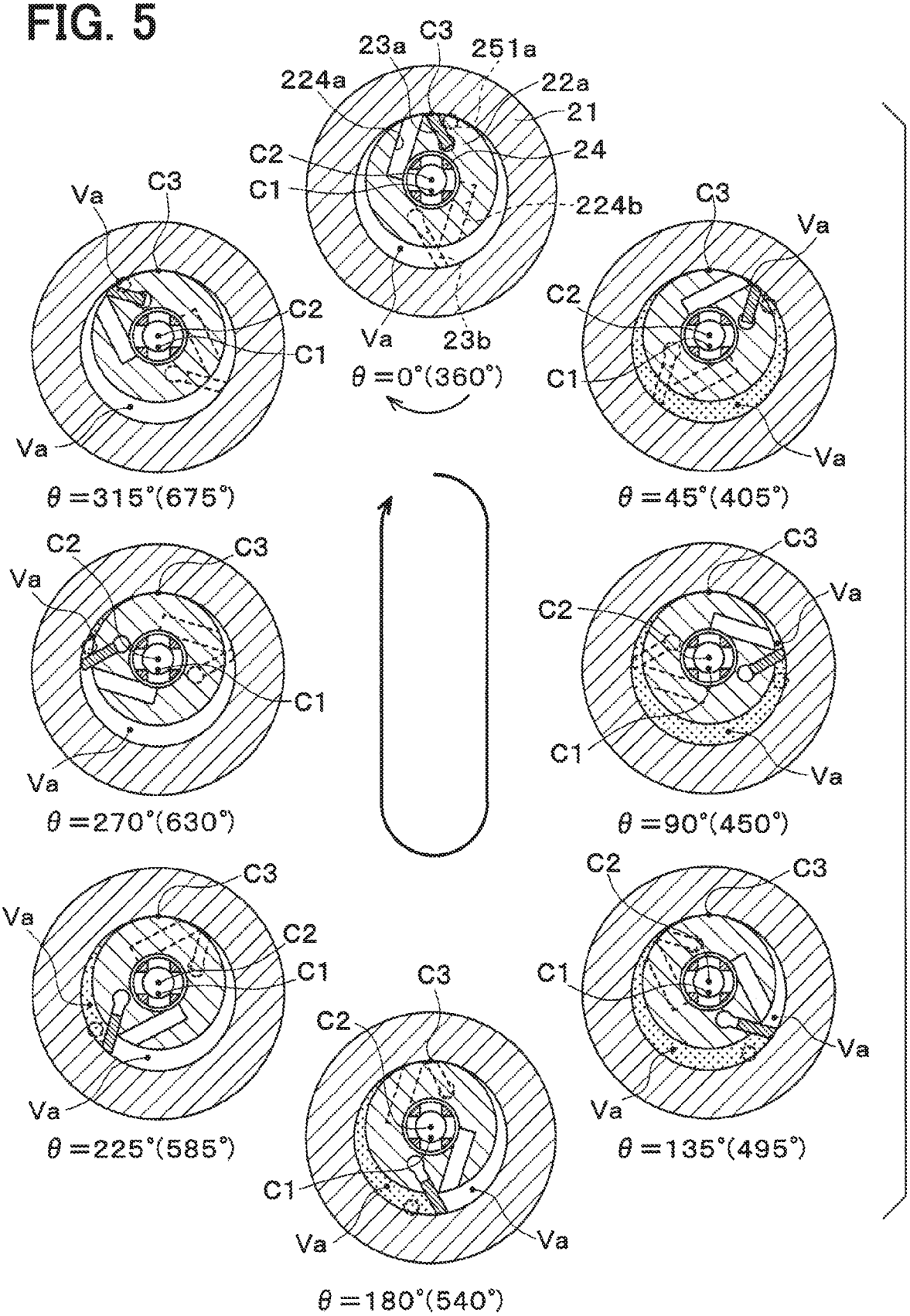
FIG. 5 is a descriptive view for describing various operational states of the compressor of the embodiment.

Next, the operation of the compressor 1 of the present embodiment will be described with reference to FIG. 5. FIG. 5 is a descriptive diagram that continuously indicates a change in the primary compression chamber Va in response to the rotation of the cylinder 21 for the purpose of describing the operational states of the compressor 1.

That is, in the cross sectional views of FIG. 5, which respectively correspond to the corresponding rotational angles θ of the cylinder 21, the location of the primary-rotor-side suction passage 224*a* and the location of the primary vane 23*a* in the cross sectional view similar to FIG. 3 are indicated by a solid line. Furthermore, in FIG. 5, the location of the secondary-rotor-side suction passage 224*b* and the location of the secondary vane 23*b* at the respective rotational angles θ are indicated by a dotted line.

Furthermore, in FIG. 5, for the sake of clarity of depiction, the reference signs of the respective constituent components are indicated only at the cross-sectional view that corresponds to the rotational angle θ of the cylinder 21 being zero degrees (i.e., θ=0 degrees), and the indication of the reference signs of the respective constituent components is omitted at the other cross-sectional views.

First of all, when the rotational angle θ is 0 degrees, the contact point C3 is overlapped with the outer-peripheral side distal end portion of the primary vane 23*a*. In this state, one primary compression chamber Va, which has a maximum volume, is formed on the front side of the primary vane 23*a* with respect to the rotational direction, and another primary compression chamber Va, which is in a suction stroke and has a minimum volume (i.e., a volume is zero), is formed on the rear side of the primary vane 23*a* with respect to the rotational direction.

Here, the primary compression chamber Va in the suction stroke refers to a primary compression chamber Va that is in a corresponding stroke, in which the volume of the primary compression chamber Va is increased. Furthermore, the primary compression chamber Va in the compression stroke refers to a primary compression chamber Va that is in a corresponding stroke, in which the volume of primary compression chamber Va is reduced.

Furthermore, when the rotational angle θ is increased from the zero degrees, the cylinder 21, the primary rotor 22*a* and the primary vane 23*a* are displaced, so that the volume of the primary compression chamber Va, which is in the suction stroke and is located on the rear side of the primary vane 23*a* with respect to the rotational direction, is increased, as indicated in the views of the rotational angles θ=45 degrees to 315 degrees in FIG. 5.

In this way, the low pressure refrigerant, which is suctioned from the suction port 12*a* formed at the sub-housing 12, flows through the housing-side suction passage 13*a*, the first-shaft-side outlet hole 240*a* of the shaft-side suction passage 24*d*, and the primary-rotor-side suction passage 224*a* in this order and is supplied to the primary compression chamber Va in the suction stroke.

At this time, a centrifugal force, which is generated in response to the rotation of the rotor 22, is exerted to the primary vane 23*a*, so that the outer-peripheral-side end portion 230*a* of the primary vane 23*a* is urged against the inner peripheral surface 210 of the cylinder 21. Thereby, the primary vane 23*a* partitions between the primary compression chamber Va, which is in the suction stroke, and the primary compression chamber Va, which is in the compression stroke.

When the rotational angle θ reaches 360 degrees (i.e., returns to the rotational angle θ=0 degrees), the volume of the primary compression chamber Va, which is in the suction stroke, reaches the maximum volume. Furthermore, when the rotational angle θ is increased from the 360 degrees, the communication between the primary compression chamber Va, which is in the suction stroke and has progressively increased its volume at the rotational angles θ=0 degrees to 360 degrees, and the primary-rotor-side suction passage 224*a*, is blocked. In this way, the primary compression chamber Va, which is in the compression stroke, is formed on the front side of the primary vane 23*a* with respect to the rotational direction.

Furthermore, when the rotational angle θ is increased from the 360 degrees, the volume of the primary compression chamber Va, which is in the compression stroke and is located on the front side of the primary vane 23*a* with respect to the rotational direction, is decreased, as indicated by the hatching in the views of the rotational angles θ=405 degrees to 675 degrees shown in FIG. 5.

In this way, the refrigerant pressure in the primary compression chamber Va, which is in the compression stroke, is increased. When the refrigerant pressure in the primary compression chamber Va exceeds a valve opening pressure (i.e., a maximum pressure of the primary compression chamber Va) of the primary discharge valve, which is determined according to the refrigerant pressure in the inside space 10*a* of the housing 10, the refrigerant in the primary compression chamber Va is discharged to the inside space 10*a* of the housing 10 through the primary discharge hole 251*a*.

In the above description of the operation, in order to clarify the operational mode of the primary compression mechanism 20*a*, the changes at the primary compression chamber Va from the rotational angles θ of 0 degrees to 720 degrees have been described. However, in reality, the suction stroke of the refrigerant, which is described with respect to the time of changing the rotational angle θ from the 0 degrees to 360 degrees, and the compression stroke of the refrigerant, which is described with respect to the time of changing the rotational angle θ from 360 degrees to 720 degrees, are simultaneously executed during one rotation of the cylinder 21.

Furthermore, the secondary compression mechanism 20*b* is also operated in a manner similar to that of the primary compression mechanism 20*a* described above to execute the compression and suction of the refrigerant. At this time, in the secondary compression mechanism 20*b*, for example, the secondary vane 23*b* is phase shifted from the primary vane 23*a* by 180 degrees. Therefore, in the secondary compression chamber Vb, which is in the compression stroke, the compression and the suction of the refrigerant are executed at the rotational angles, which are phase shifted from those of the primary compression chamber Va by 180 degrees.

Thus, in the present embodiment, the rotational angle θ of the cylinder 21, at which the refrigerant pressure of the primary compression chamber Va reaches its maximum pressure, is phase shifted by 180 degrees from the rotational angle θ of the cylinder 21, at which the refrigerant pressure of the secondary compression chamber Vb reaches its maximum pressure.

When the refrigerant pressure in the secondary compression chamber Vb, which is in the compression stroke, is increased and exceeds the valve opening pressure of the secondary discharge valve installed to the secondary side plate 25*b* (i.e., the maximum pressure of the secondary compression chamber Vb), the refrigerant of the secondary compression chamber Vb is discharged to the inside space 10*a* of the housing 10 through the secondary discharge hole 251*b*.

The refrigerant, which is discharged from the secondary compression mechanism 20*b* to the inside space 10*a* of the housing 10, is merged with the refrigerant, which is discharged from the primary compression mechanism 20*a*, and this merged refrigerant is discharged from the discharge port 11*a* of the housing 10.

As discussed above, the compressor 1 of the present embodiment can suction, compress and discharge the refrigerant, which is the fluid, at the refrigeration cycle system. Furthermore, in the compressor 1 of the present embodiment, since the compression mechanism 20 is placed at the inner peripheral side of the electric motor unit 30, the size of the entire compressor 1 can be made compact.

Furthermore, in the compressor 1 of the present embodiment, the maximum volume of the primary compression chamber Va and the maximum volume of the secondary compression chamber Vb are generally equal to each other. Also, the rotational angle θ of the cylinder 21, at which the pressure of the refrigerant in the primary compression chamber Va reaches the maximum pressure, is phase shifted by 180 degrees from the rotational angle θ of the cylinder 21, at which the pressure of the refrigerant in the secondary compression chamber Vb reaches the maximum pressure.

Thereby, it is possible to more effectively limit the torque fluctuation in terms of the whole compressor in comparison to a cylinder-rotation-type compressor that includes a single compression mechanism, a discharge capacity of which is equal to a sum of a discharge capacity of the primary compression chamber Va and a discharge capacity of the secondary compression chamber Vb of the present embodiment. Therefore, an increase in the noise and an increase in the vibration can be limited in terms of the whole compressor.

The torque fluctuation in terms of the whole compressor according to the present embodiment may be a sum value (i.e., a total torque change) of the torque fluctuation, which is generated by the pressure change of the refrigerant in the primary compression chamber Va of the primary compression mechanism 20*a*, and the torque fluctuation, which is generated by the pressure change of the refrigerant in the secondary compression chamber Vb of the secondary compression mechanism 20*b*.

Furthermore, at the primary compression mechanism 20*a* of the present embodiment, in the view taken in the axial direction of the eccentric axis C2, the primary groove 222*a* and the primary-rotor-side suction passage 224*a* progressively get closer to each other from the inner peripheral side toward the outer peripheral side of the primary rotor 22*a*. Furthermore, the fluid outlet of the primary-rotor-side suction passage 224*a* opens at the corresponding location that is immediately after the primary groove 222*a* on the rear side of the primary groove 222*a* with respect to the rotational direction.

Therefore, the fluid outlet of the primary-rotor-side suction passage 224*a*, which is formed at the outer surface of the primary rotor 22*a*, can be placed adjacent to a contact location, at which the primary vane 23*a* contacts the cylinder 21.

Thereby, the fluid outlet of the primary-rotor-side suction passage 224*a* can be immediately communicated with the primary compression chamber Va, which is in the state immediately after starting of the suction stroke. Thus, it is possible to limit a decrease in the pressure of the primary compression chamber Va that is in the state immediately after the starting of the suction stroke.

Furthermore, it is possible to immediately block the communication of the fluid outlet of the primary-rotor-side suction passage 224*a* to the primary compression chamber Va that is in the state immediately after starting of the compression stroke. Thus, it is possible to limit an occurrence of a state where the fluid is not compressed in the primary compression chamber Va that is in the state immediately after the starting of the compression stroke.

As a result, the compressor 1 of the present embodiment can effectively limit an increase in the energy loss of the cylinder-rotation-type compressor.

Furthermore, in the primary compression mechanism 20*a* of the present embodiment, the primary groove 222*a* is shaped into the form, which extends and tilts toward the rear side with respect to the rotational direction of the primary rotor 22*a*. Thus, in the view taken in the axial direction of the eccentric axis C2, it is very easy to implement the configuration of that the primary groove 222*a* and the primary-rotor-side suction passage 224*a* progressively get closer to each other from the inner peripheral side toward the outer peripheral side of the primary rotor 22*a*.

Here, like in the case of the present embodiment, the form of the primary groove 222*a*, which extends and tilts toward the rear side with respect to the rotational direction of the primary rotor 22*a*, possibly causes an increase in a mechanical loss caused by friction between the primary vane 23*a* and the cylinder 21 and is thereby less likely used in general. However, in the compressor 1 of the present embodiment, even though the primary groove 222*a* is shaped into the form, which extends and tilts toward the rear side with respect to the rotational direction of the primary rotor 22*a*, it does not cause an increase in the mechanical loss.

Figure 6:
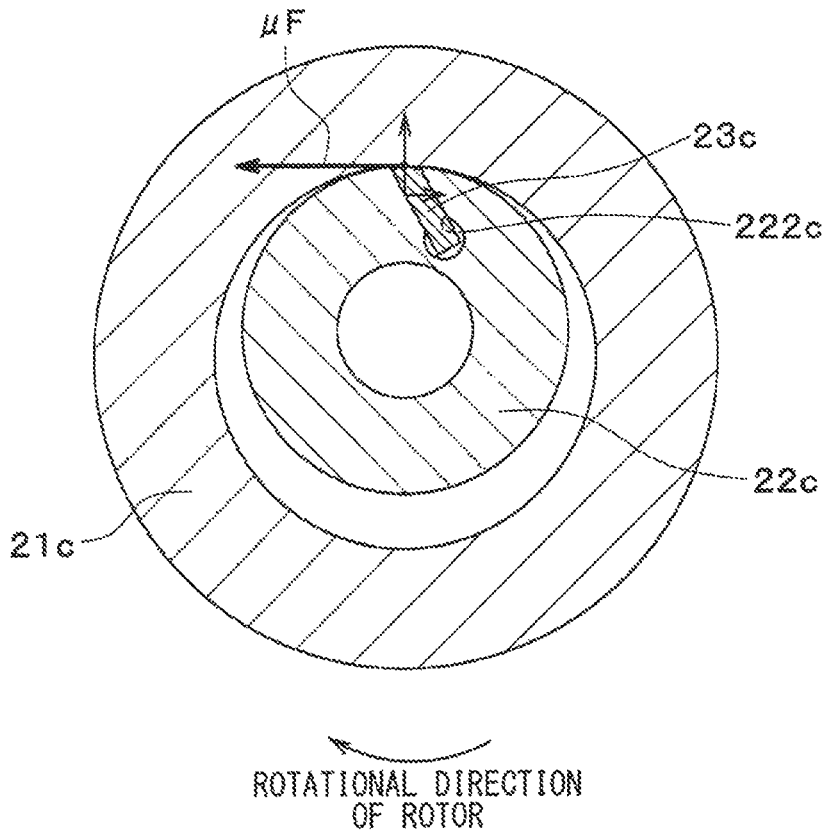
FIG. 6 PRIOR ART
FIG. 6 is a descriptive view for describing a frictional force in an ordinary vane type compressor.

This point will be described with reference to FIG. 6. FIG. 6 shows a cross section of an ordinary vane type compression mechanism, which is perpendicular to the axial direction. The ordinary vane type compressor shown in FIG. 6 is a type that rotates a rotor 22*c* in an inside of a cylinder 21*c* without rotating the cylinder 21*c* relative to the rotor 22*c*.

Therefore, in the ordinary vane type compressor, when the rotor 22*c* is rotated, a vane 23*c*, which is fitted into a groove 222*c* of the rotor 22*c*, is urged against an inner peripheral surface of the cylinder 21. In this way, a friction is generated between an outer-peripheral-side end portion of the vane 23*c* and the inner peripheral surface of the cylinder 21, so that a frictional force μF is applied to the outer-peripheral-side end portion of the vane 23*c* in a counter-rotational direction.

Furthermore, in the ordinary vane type compressor, as shown in FIG. 6, when the groove 222*c* is shaped into the form, which extends and tilts toward the rear side with respect to the rotational direction of the rotor 22*c*, the vane 23*c* receives a load from a surface of the groove 222*c* located on the rear side with respect to the rotational direction such that the load is directed toward the front side with respect to the rotational direction and is also directed toward the radially outer side. Therefore, the frictional force μF, which is applied to the outer-peripheral-side end portion of the vane 23*c*, is increased to result in an increase in the mechanical loss that is caused by the friction between the outer-peripheral-side end portion of the vane 23*c* and the inner peripheral surface of the cylinder 21*c*.

Therefore, in the ordinary vane type compressor, there is a very small number of precedents with respect to the configuration of the groove 222*c* that extends and tilts toward the rear side with respect to the rotational direction. That is, in the type of compressor, in which the vane 23*c* is slidably fitted into the groove 222*c* of the rotor 22*c*, there is a very small number of precedents with respect to the configuration of the groove 222*c* that extends and tilts toward the rear side with respect to the rotational direction.

In contrast, in the cylinder-rotation-type compressor, in which the cylinder 21 and the primary rotor 22*a* are synchronously rotatable, like in the case of the compressor 1 of the present embodiment, a relative displacement between the outer-peripheral-side end portion 230*a* of the primary vane 23*a* and the inner peripheral surface 210 of the cylinder 21 is relatively small. This is understandable based on the fact of that the amount of relative displacement between the outer-peripheral-side end portion 230*a* of the primary vane 23*a* and the primary discharge hole 251*a*, which is indicated by the dotted line, is relatively small in FIG. 5.

Therefore, according to the compressor 1 of the present embodiment, it is possible to limit an increase in the frictional force μF described above, and thereby an increase in the mechanical loss caused by the friction between the cylinder 21 and the primary vane 23*a* can be limited. As a result, according to the compressor 1 of the present embodiment, an increase in the energy loss of the cylinder-rotation-type compressor 1 can be very effectively limited. The above-described increase limiting effect for limiting the increase in the energy loss can be also similarly achieved in the secondary compression mechanism 20*b*.

Other Embodiments

The present disclosure should not be limited to the above embodiment, and the above embodiment may be modified in various ways as discussed below without departing from the scope of the present disclosure.

In the above embodiment, there is described the exemplary case where the cylinder-rotation-type compressor 1 of the present disclosure is applied to the refrigeration cycle of the vehicle air conditioning apparatus. However, the application of the cylinder-rotation-type compressor 1 of the present disclosure should not be limited to this application. Specifically, the cylinder-rotation-type compressor 1 of the present disclosure can be used in wide variety of applications as any of compressors, which compress various types of fluids.

In the above embodiment, there is described the exemplary case where the structure, which is similar to the pin and hole type self-rotation limiting mechanism, is used as the drive force transmitting means of the cylinder-rotation-type compressor 1. However, the drive force transmitting means of the present disclosure should not be limited to this type. For example, a structure, which is similar to a self-rotation limiting mechanism of an Oldham ring type, may be used.

In the above embodiment, the cylinder-rotation-type compressor 1, which includes the plurality of compression mechanisms, is described. Alternatively, a cylinder-rotation-type compressor 1, which includes a single compression mechanism, may be used.

In the above embodiment, there is used the electric motor unit 30 that includes the stator, which is placed at the outer peripheral side of the cylinder 21 that is formed integrally with the rotor as the one-piece body. However, the type of electric motor unit 30 should not be limited to this type. For example, the electric motor unit and the cylinder 21 may be placed one after another in the axial direction of the central axis C1 of the cylinder 21, and the electric motor unit and the cylinder 21 may be coupled with each other. Further alternatively, the rotational drive force of the electric motor unit may be transmitted to the cylinder 21 through a belt without coaxially arranging the rotational center of the electric motor unit and the central axis C1 of the cylinder 21.

The invention claimed is:

1. A cylinder-rotation compressor comprising:

a cylinder that is shaped into a cylindrical tubular form and is rotatable about a central axis;

a rotor that is shaped into a cylindrical tubular form and is placed in an inside of the cylinder, wherein the rotor is rotatable about an eccentric axis, which is eccentric to the central axis of the cylinder;

a shaft that rotatably supports the rotor; and a vane that is shaped into a plate form and is slidably inserted into a groove formed in the rotor, while the vane partitions a compression chamber that is formed between an outer peripheral surface of the rotor and an inner peripheral surface of the cylinder, wherein:

the cylinder and the rotor are synchronously rotatable;

when the rotor is rotated, the vane is displaced such that an outer-peripheral-side end portion of the vane contacts the inner peripheral surface of the cylinder;

a shaft-side suction passage, which conducts fluid received from an outside, is formed in an inside of the shaft;

a rotor-side suction passage, which conducts the fluid outputted from the shaft-side suction passage to the compression chamber, is formed in an inside of the rotor;

in a view taken in an axial direction of the eccentric axis, the groove is formed to extend in a direction that is tilted relative to a radial direction of the rotor;

the groove extends from an inner peripheral side toward an outer peripheral side of the rotor and extends and tilts toward a rear side with respect to a rotational direction of the rotor; and in the view taken in the axial direction of the eccentric axis, the groove and the rotor-side suction passage are formed such that the groove and the rotor-side suction passage progressively get closer to each other from the inner peripheral side toward the outer peripheral side of the rotor.

2. The cylinder-rotation compressor according to claim 1, wherein in the view taken in the axial direction of the eccentric axis, a fluid outlet of the rotor-side suction passage opens at a corresponding location of the outer peripheral surface of the rotor, which is immediately before a location of the groove on the rear side of the location of the groove with respect to the rotational direction of the rotor.

3. The cylinder-rotation compressor according to claim 1, wherein in the view taken in the axial direction of the eccentric axis, a fluid outlet of the rotor-side suction passage opens at a corresponding location of the outer peripheral surface of the rotor, which is adjacent to a location of the groove on the rear side of the location of the groove with respect to the rotational direction of the rotor.

* * * * *